United States Patent [19]

Carlstedt et al.

[11] 4,400,957

[45] Aug. 30, 1983

[54] STRIP OR SHEET MILL WITH IMPROVED REGULATING DEVICE AND METHOD

[75] Inventors: Anders Carlstedt; Åke Nilsson, both of Västerås, Sweden

[73] Assignee: ASEA Aktiebolag, Västerås, Sweden

[21] Appl. No.: 256,605

[22] Filed: Apr. 22, 1981

[30] Foreign Application Priority Data

Apr. 25, 1980 [SE] Sweden ..... 8003137

[51] Int. Cl.[3] ..... B21B 37/12; B21B 31/18; B21B 31/20

[52] U.S. Cl. ..... 72/8; 72/12; 72/243; 72/247; 364/472

[58] Field of Search ..... 72/8, 9, 11, 12, 241, 72/243, 247; 364/472

[56] References Cited

U.S. PATENT DOCUMENTS 3,756,050 9/1973 Kubo et al. ..... 72/9
3,890,834 6/1975 Henze ..... 73/862.07
3,902,345 9/1975 Shida ..... 72/247

*Primary Examiner*—Lowell A. Larson
*Assistant Examiner*—Jonathan L. Scherer
*Attorney, Agent, or Firm*—Watson, Cole, Grindle & Watson

[57] ABSTRACT

The invention relates to a strip or sheet mill having working rolls, backup rolls and axially displaceable intermediate rolls positioned therebetween. Associated with the rolled strip of the rolling mill is a flatness measuring device (e.g., for measuring the distribution of the strip tension over the strip width), the output signals of the flatness measuring device being fed, together with signals representing the strip width, to at least two different evaluating members, one of these serving to deliver a regulating signal for adjusting the crown of the working rolls, and the other serving to deliver a regulating signal for adjusting the axial positions of the intermediate rolls.

7 Claims, 1 Drawing Figure

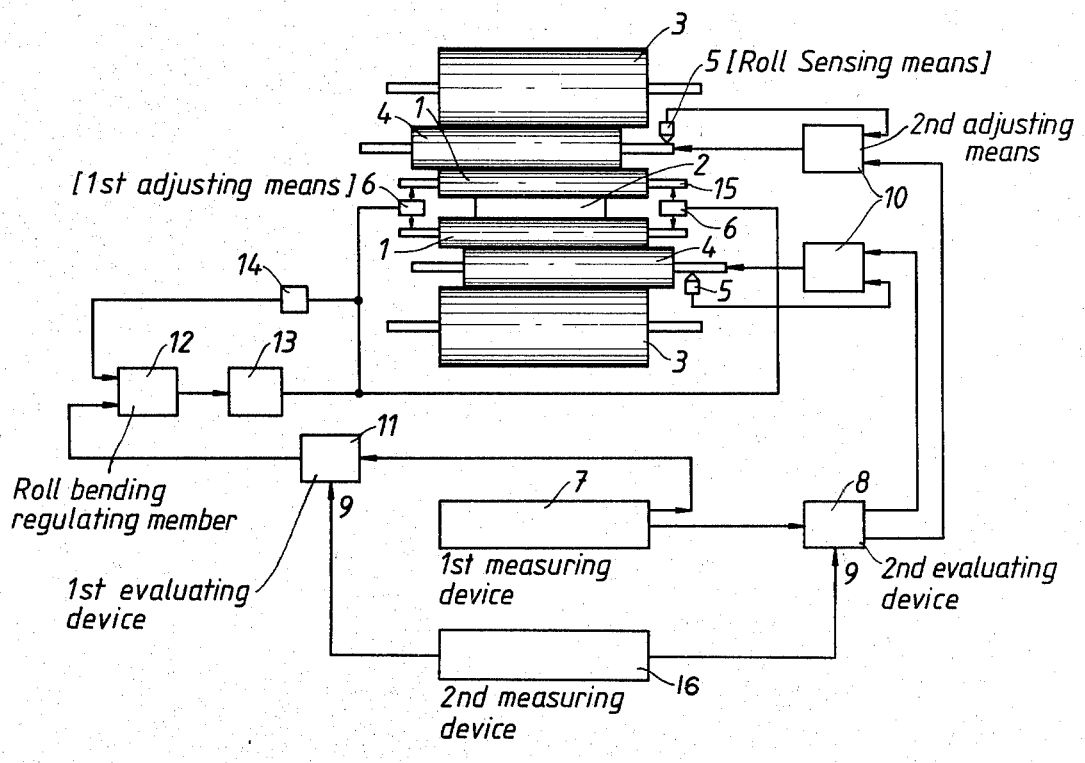
3
5 [Roll Sensing means]
4
1
2nd adjusting means
2
[1st adjusting means] 6
15
10
6
1
4
14
5
12
13
3
11
Roll bending regulating member
9
7
8
1st measuring device
9
2nd evaluating device
1st evaluating device
2nd measuring device
16

STRIP OR SHEET MILL WITH IMPROVED REGULATING DEVICE AND METHOD

TECHNICAL FIELD

The present invention relates to a strip or sheet mill having a pair of working rolls, a pair of backup rolls and a pair of axially displaceable intermediate rolls, one intermediate roll being positioned between each working roll and its adjacent backup roll, as well as a regulating device for the mill. The invention also relates to a method of regulating such a strip/sheet rolling mill.

In rolling mills of the kind described it is desirable to ensure good flatness of the outgoing rolled material. The flatness of the rolled material is controlled by changing the "crown" (i.e. the axial bending) of the working rolls and also by adjusting the length of an intermediate roll which is actually in contact with the adjacent working roll.

BACKGROUND ART

From German Offenlegungsschrift No. 2334492 it is known in such rolling mills to measure the pressure applied by the working rolls and the width of the material being rolled in order to obtain a signal for the optimum intermediate roll position and the optimum crown force. These measuring signals are used in a mathematical model of the rolling mill in order to obtain the correct regulating signal. Thus this prior invention is dependent on a mathematical operation and use is not made of any measurement of the flatness of the rolled material.

It is also known from U.S. Pat. No. 3,534,571 to measure the roll pressure and, while using this measured value, to control the crown of the working rolls in a four-high rolling mill. However, with this arrangement problems may also arise in obtaining a truly flat end product, since again no direct measurement of the flatness of the rolled product is made.

The present invention aims to provide a solution to the above-mentioned problems and other problems associated therewith in connection with a rolling mill of the above-described kind.

SUMMARY OF THE INVENTION

According to one aspect of the present invention a strip/sheet rolling mill has a pair of working rolls, a pair of backup rolls and a pair of axially displaceable intermediate rolls, one intermediate roll being positioned between each working roll and its adjacent backup roll, and a regulating system for the mill, which comprises first means to adjust the crown of the working rolls and second means to adjust the axial positions of the intermediate rolls relative to their associated working and backup rolls, a first measuring device downstream of the working rolls for measuring the flatness of material rolled between the working rolls, a second measuring device for determining the width of the rolled material and first and second evaluating devices to both of which output signals from the first and second measuring devices are fed, the first evaluating device being arranged to deliver a regulating signal to the first means for adjusting the crown of the working rolls, and the second evaluating device being arranged to deliver a regulating signal to the second means for adjusting the intermediate roll positions.

The measuring device for measuring the flatness of the rolled material may sense the distribution of strip tension across the width of the rolled material (i.e., as described in U.S. Pat. No. 3,481,194, or Swedish Pat. No. 321365). Such a measuring device is known under the Trade Mark ASEA-STRESSOMETER.

By employing a rolling mill in accordance with the invention, a rolled product having food flatness is obtained without the need to measure roll pressure or roll force. No built-in pressure or force measuring means in the mill stand are necessary for regulating a mill in accordance with the invention.

According to a further aspect of the invention, there is provided a method of regulating a strip/sheet rolling mill having a pair of working rolls, a pair of backup rolls and a pair of axially displaceable intermediate rolls, one intermediate roll being positioned between each working roll and its adjacent backup roll, first means to adjust the crown of the working rolls and second means to adjust the axial positions of the intermediate rolls relating to their associated working and backup rolls, which method comprises deriving: a first control signal related to the flatness of the rolled material and a second control signal related to the width of the rolled material and controlling both the first adjusting means and the second adjusting means with regulating signals each derived from the first and second control signals.

BRIEF DESCRIPTION OF THE DRAWING

The invention will be exemplified in greater detail, by way of example, with reference to the accompanying drawing, the sole figure of which schematically represents a rolling mill according to the invention.

BEST MODE OF CARRYING OUT THE INVENTION

A pair of working rolls 1 roll out a strip 2 of metal of a certain width, which is measured, if not known. The rolling mill is provided with backup rolls 3 and with intermediate rolls 4, one of the intermediate rolls 4 being positioned between each backup roll 3 and its associated working roll 1. The intermediate rolls 4 are displaceable in their axial directions, the axial positions thereof being indicated by respective roll sensing means 5. The desired crown of the working rolls 1 is achieved by means of first adjusting means or hydraulic devices 6.

A first measuring device 7, which measures the flatness of the strip or the distribution of the strip tension across the strip width, is arranged along the path of the rolled metal strip 2, downstream of the gap between the rolls 1 but upstream of a recoiler (not shown) or a subsequent rolling mill.

A plurality of signals emanate from the above-mentioned measuring device 7, some of which are supplied to a second evaluating device 8, which is also supplied with a signal 9 from a second measuring device 16 which is proportioned to the width of the strip. The output signals of the second evaluating device 8 are used to adjust the axial positions of the intermediate rolls 4 via second adjusting means or position-regulating devices 10.

In a closed regulating circuit, the output signal of the appropriate roll sensing means or measuring device 5 is fed to the respective second adjusting means or position-regulating device 10, and the intermediate rolls 4 are adjusted in accordance with the output signals of the first measuring device 7 in order to optimise the flatness.

The output signals from the first measuring device 7, as well as the strip width signals 9, are also supplied to a first evaluating device 11, and the output signals from this first evaulating device 11 are supplied to a roll bending regulating member 12 which, via a servo valve 13 (or the like), controls the first adjusting means or hydraulic devices 6, which set the crown of the working rolls.

The hydraulic pressure fed to the devices 6 will be a measure of the crown in question, and this pressure is sensed by a third measuring device 14, the output signals from which are supplied, in a closed feed back loop, to the roll bending regulating member 12.

Thus, the hydraulic devices 6 and the position-regulating devices 10 act together to control the flatness of the outgoing rolled metal without roll pressure or roll force being measured.

The crown, i.e., the bending of the working rolls, is applied in a conventional manner by means of the hydraulic devices 6 acting on the ends 15 of the rolls 1, and the servo device 13 controls the bending force applied.

The second measuring device 16 provides a strip width signal 9 in a conventional manner, for example by means of sensing members responsive to the strip width, which adjust potentiometers. However, these may also be manually adjusted when sensing the strip width. The output signal is thus the above-mentioned strip width signal.

The intermediate rolls 4 are adjusted in a direction lateral to the rolling direction by means of the position-regulating devices 10 which can be conventional hydraulic devices controlled by signals in the manner described above.

The precise arrangement shown in the drawing may be varied in many ways within the scope of the following claims.

What is claimed is:

1. A strip or sheet rolling mill which includes a pair of working rolls between which the strip or sheet passes; a pair of backup rolls, one backup roll being associated with one working roll; a pair of axially displaceable intermediate rolls, one intermediate roll being positioned between a working roll and its associated backup roll; and a regulating system for the mill, said regulating system comprising first adjusting means for adjusting the crown of the working rolls, the first adjusting means being hydraulically operated, second adjusting means for adjusting the axial position of the intermediate rolls relative to their associated working and backup rolls, a first measuring device positioned downstream of the working rolls for measuring the flatness of the rolled strip or sheet and for generating a corresponding flatness signal, a second measuring device positioned downstream of the working rolls for measuring the width of the rolled strip or sheet and for generating a corresponding width signal, a hydraulic supply means for supplying hydraulic fluid to the first adjusting means, the hydraulic supply means including a control valve, a regulating means connected to the control valve to control its operation, a third measuring device for measuring the pressure in the hydraulic supply means and for providing a corresponding pressure signal which is passed to the regulating means, a first evaluating device to which the flatness signal and the width signal are fed, the first evaluating device providing a first control signal which is fed to the regulating means, a second evaluating device to which the flatness signal and the width signal are fed, the second evaluating device providing a second control signal which is fed to the second adjusting means to control its operation, the regulating member controlling the operation of the control valve in the hydraulic supply means based on both the received pressure signal and the first control signal to thereby control the operation of the first adjusting means and thus the crown of the working rolls.

2. The strip or sheet rolling mill as defined in claim 1 wherein the first adjusting means includes separate hydraulic devices located adjacent the opposite ends of the working rolls, each hydraulic device being connected to the adjacent ends of the working rolls to apply a force thereon and cause bending thereof.

3. The strip or sheet rolling mill as defined in claim 1 wherein the second adjusting means comprises separate position regulating devices connected to the ends of each of the intermediate rolls, and wherein separate roll sensing means are provided for sensing the axial positioning of each intermediate roll, a signal from each roll sensing means being fed to the respective position regulating device which adjusts the axial position of the associated intermediate roll.

4. The strip or sheet rolling mill as defined in claim 1 wherein the first mesuring device measures the distribution of tension in the rolled strip or sheet across its width.

5. A method of regulating a strip or sheet rolling mill, which mill includes a pair of working rolls between which the strip or sheet passes; a pair of backup rolls, one backup roll being associated with one working roll; a pair of axially displaceable intermediate rolls, one intermediate roll being positioned between a working roll and its associated backup roll; hydraulic first adjusting means for adjusting the crown of the working rolls; second adjusting means for adjusting the axial position of the intermediate rolls relative to their associated working and backup rolls; a hydraulic supply means including a control valve for supplying hydraulic fluid to the first adjusting means; and a regulating member for controlling the control valve; the method comprising the steps of measuring the flatness of the strip or sheet emanating from between the working rolls and providing a flatness signal based thereon, measuring the width of the strip or sheet emanating from between the working rolls and providing a width signal based thereon; measuring the pressure of the hydraulic fluid in the hydraulic supply means and providing a pressure signal based thereon; comparing the flatness signal and the width signal to provide first and second control signals; passing the first control signal and the pressure signal to the regulating member to enable it to control the control valve and thus the operation of the hydraulic first adjusting means; and passing the second control signal to the second adjustment means to control its operation.

6. The method as defined in claim 5 including the steps of determining the axial positioning of each intermediate roll and providing a third control signal based thereon, and supplying this third control signal to the second adjusting means.

7. The method as defined in claim 5 wherein the step of measuring the flatness of the strip or sheet emanating from between the working rolls comprises determining the distribution of tension across the width of the rolled strip or sheet.

* * * * *